United States Patent [19]

Kowalik

[11] Patent Number: 5,072,082

[45] Date of Patent: Dec. 10, 1991

[54] ELECTROMAGNETICALLY LOCKED CONTACT BLADE

[75] Inventor: Peter M. Kowalik, Trafford, Pa.

[73] Assignee: Cleaveland/Price Inc., Trafford, Pa.

[21] Appl. No.: 491,237

[22] Filed: Mar. 9, 1990

[51] Int. Cl.[5] ..... H01H 33/02

[52] U.S. Cl. ..... 200/147 R; 335/16; 335/195

[58] Field of Search ..... 200/144 R, 146 R, 147 R, 200/48 R, 48 A, 48 KB; 361/9, 13, 115; 335/167, 168, 170, 195, 201, 16, 147

[56] References Cited

U.S. PATENT DOCUMENTS

| | | | |
|---|---|---|---|
| 2,959,654 | 11/1960 | Caswell et al. | 200/146 R |
| 3,238,339 | 3/1966 | Fehling | 200/146 R |
| 4,379,956 | 4/1983 | Cleaveland et al. | 200/48 A |
| 4,849,590 | 7/1989 | Becker et al. | 200/147 R |

*Primary Examiner*—J. R. Scott

*Attorney, Agent, or Firm*—W. D. Palmer

[57] ABSTRACT

A high voltage ground blade assembly which has a folding member to aid in breaking ice and lowering the force to operate the blade assembly in combination with an electric coil which creates an electromagnetic force to prevent the folding member from moving when the blade assembly is in closed position and the blade assembly is conducting very high short-circuit current.

15 Claims, 5 Drawing Sheets

FIG. 1
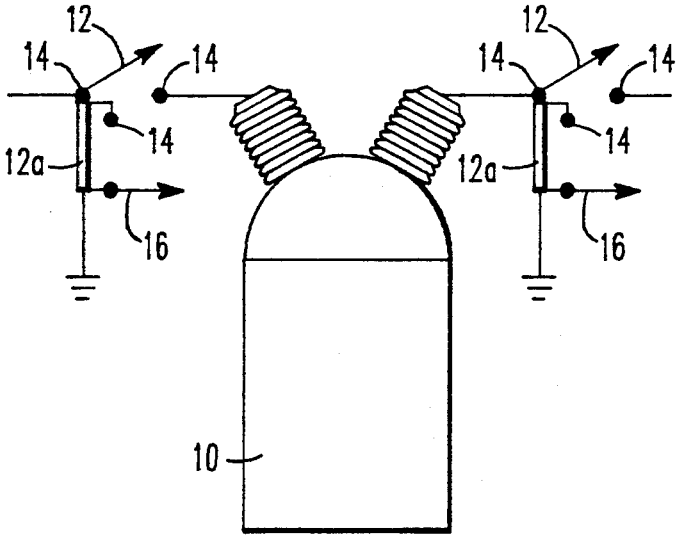
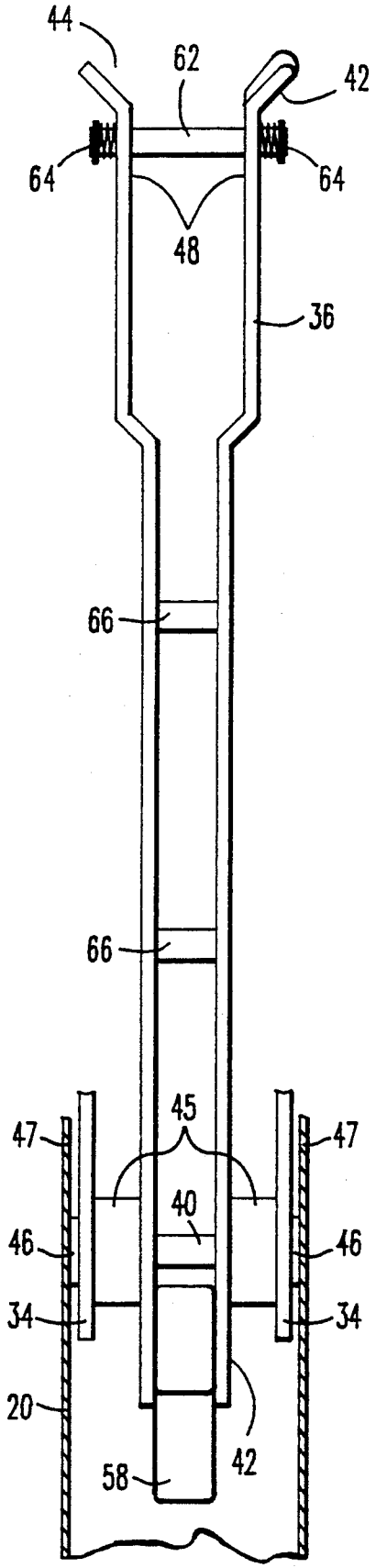
FIG. 5

ELECTROMAGNETICALLY LOCKED CONTACT BLADE

BACKGROUND OF THE INVENTION

This invention related to contact blades for use in electrical distribution systems and which are electromagnetically locked in closed position and, more particularly, to contact blades which are used for positively grounding high-voltage circuits for maintenance and repair operations.

After voltage has been removed from a high voltage circuit, ground blades are used to solidly ground the circuit, making it safe for maintenance, etc. The ground blades span the length of the circuit insulators when the blades are closed. Higher voltages require longer ground blades and consequently much higher operating forces. The high operating forces, especially under ice conditions of ground blades and side break disconnect switches, are often reduced by putting a folding joint in the blade near the disconnecting end of the blade to achieve a toggling or prying action. This folding or toggle blade makes opening extremely easy, which is a serious problem with long straight blades; however, it also makes it easy for electromagnetic forces, such as those generated by neighboring phases during short circuits, to "blow open" the blades, especially at high momentary ratings, even through the blades may be rigidly connected to a drive mechanism.

SUMMARY OF THE INVENTION

There is provided in combination with a toggle-type blade assembly an electromagnetic locking system which locks the blade closed under momentary conditions of extremely heavy current flow. The toggle-type blade unit comprises a hinged rigid elongated conductor means which is rotatable through a limited arc to open and close the blade. A toggle blade is hinged to the conductor means a predetermined distance from the free end of the conductor means and the free end of the toggle blade extends beyond the free end of the elongated conductor means. The free end of the toggle blade comprises an electrical contact which mates with so-called break-jaws when the blade is in closed current-carrying position. The toggle blade is normally urged toward an open position.

The improved blade locking arrangement comprises an elongated electrically conducting coil means which is rigidly electrically connected to the rigid elongated conductor means of the ground blade at a location which is spaced a predetermined distance from the toggle blade hinge and toward the free end of the rigid elongated conductor means. The conductor coil means has a "C-type" configuration which (1) first extends away from the rigid elongated conductor means and (2) then bends to extend generally parallel to the rigid elongated conductor means and toward the toggle blade hinge to space the conductor coil from the rigid elongated conductor means and (3) then bends toward the rigid elongated conductor means and electrically connects to the toggle blade proximate the blade hinge. The blade hinge includes a first insulating means which insulates the toggle blade from the rigid elongated conductor means. A second insulating means maintains a predetermined close spacing between the toggle blade and the rigid elongated conductor means when the blade is in closed position. An electrically conducting spacer is positioned between the toggle blade and the conducting coil so that the two are electrically connected. When the toggle blade is in a closed current-carrying position, current can flow from the break-jaws through the toggle blade and then in reverse direction through the conductor coil and then, again reversing direction, current flow is into the rigid elongated conductor means. Under extremely heavy current flow conditions, the reverse nature of the respective current flows and the resultant electromagnetic forces lock the toggle blade in closed position.

BRIEF DESCRIPTION OF THE DRAWINGS

For a better understanding of the invention, reference should be made to the accompanying drawings wherein:

FIG. 1 is a diagrammatic showing of a conventional circuit breaker isolated by disconnect switches, with high-voltage conductors grounded via the ground blades, preparatory to maintenance, etc.;

FIG. 5 is a fragmentary view, slightly enlarged, showing a toggle blade, spacers, blade locking member and blade hinge.

DESCRIPTION OF THE PREFERRED EMBODIMENTS

The diagrammatic view shown in FIG. 1 represents the state of the art wherein the circuit breaker 10 has been prepared for maintenance, repairs, etc. In this showing, disconnect switches 12 have been provided on both the power source and load sides of the breaker 10. The disconnect switches 12 open the circuit at the terminals 14 of the current mains. Ground blades 16 are then connected in a closed position between the current mains terminals 14 and ground. Any voltage encountered in the circuit would flow through a ground blade and this would trip other circuit breakers with the breaker undergoing maintenance being grounded for safety purposes. Disconnect switches could be provided only on one side of the breaker, if desired, and ground blades could be provided on both terminals of the disconnect switches, if desired, according to the substation design.

Figure 2:
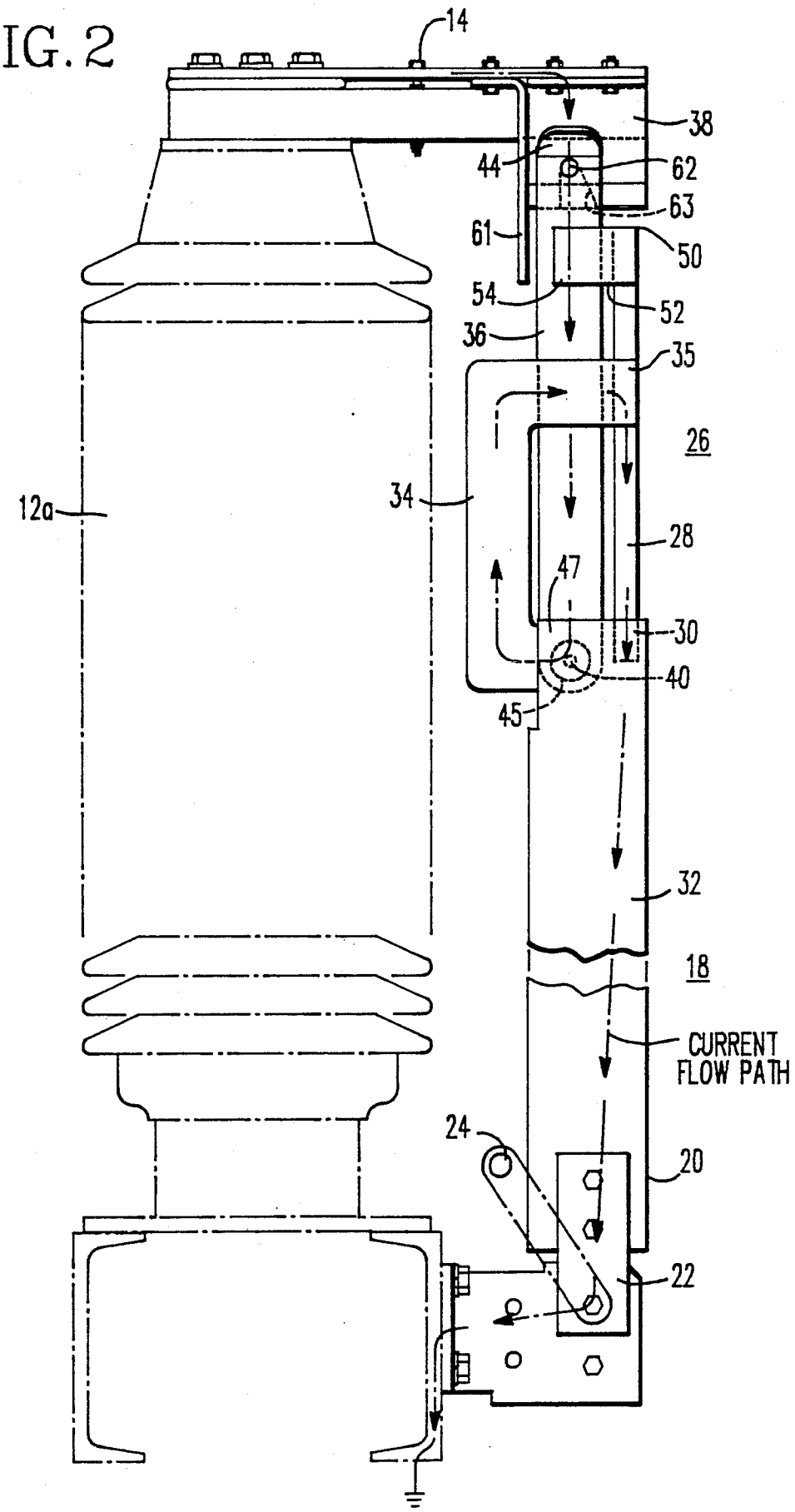
FIG. 2 is a side elevational view of a ground blade of the present invention in closed position showing its mounting with respect to an insulator of the disconnect switch.
Figure 3:
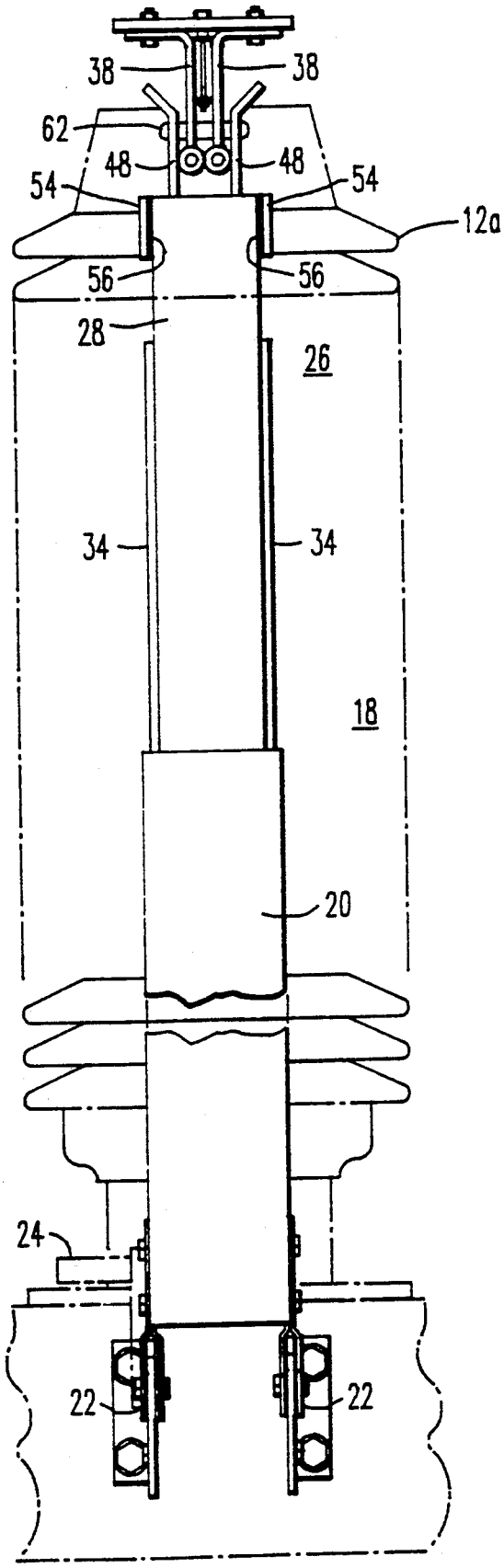
FIG. 3 is front elevation of the closed ground blade as shown in FIG. 2.

A ground blade assembly 18 fabricated in accordance with the present invention is shown in current-carrying position in FIGS. 2 and 3. The ground blade assembly comprises a rigid elongated conductor extension 20 adapted to carry very high currents, such as up to 120,000 amperes. For structural design reasons, this conductor 20 is fabricated as a hollow heavy-wall aluminum conductor with a hinge 22 connected at the bottom portion thereof so that the entire blade assembly is rotatable through approximately a 90 degree angle to open and close the ground blade assembly 18. The bottom portion of the conductor 20 connects to ground through the hinge 22. Means are provided to rotate the blade assembly and can comprise any of several conventional actuating devices and a manually operated lever and linkage 24 is shown in diagrammatic form in FIG. 2.

A toggle blade assembly 26 is affixed to the other end of the rigid conductor extension 20 and the blade assembly comprises a rigid primary conductor 28 which is rigidly affixed proximate one end 30 to the rotatable end 32 of the rigid conductor extension 20. Both of the rigid conductors 20 and 28 could be fabricated as a single unit, but due to the application demands, it is more practical to fabricate the conductor extension 20 of heavy walled square-tube aluminum with the conductor member 28 fabricated of aluminum plate having a cross-section of three inches (7.6 cm) by three-quarter inch (1.9 cm).

For purposes of terminology, the member 20 will be referred to as a rigid conductor extension and the member 28 will be referred to as a rigid primary conductor. The two conductors 20 and 28 can be considered as a unitary conductor and in such case will be referred to as a rigid elongated conductor means. The actual operative toggle-type assembly 26 can have a dimensionally standard design, if desired, and the extension conductor 20 can be varied in length to accommodate different designs of voltage rating. As an example, the length of the conductor extension 20 can be varied from thirty inches (76.2 cm) to eighty inches (203.2 cm).

The coil means 34 is rigidly electrically connected to the rigid elongated conductor member 28 at a location 35 which is substantially spaced from the end 30 of the conductor member 28, an example of the spacing being about ten and one-quarter inches (26 cm). The coil means 34 is generally "C" shaped and is conformed to (1) first extend away from the rigid elongated conductor member 28 and toward the toggle blade 36 and (2) then bend to run parallel to the conductor member 28 and (3) then bend again toward the member 28 toward a location proximate the connected end 30 of the member 28 and terminate at the hinging point 40, see FIG. 4. The conductor coil means 34 is preferably fabricated of a pair of copper bars each having sectional dimensions of two and one-quarter inches (5.7 cm ) by one-quarter inch (6.4 mm). The main portion of the conductor coil 34 and the conductor 28 are spaced from one another about four and one-half inches (11.4 cm) measured on centers. The generally parallel positioning of the ground blade assembly 18 with respect to the insulator 12*a* of the disconnect switch 12 is also shown in FIG. 2.

Figure 4:
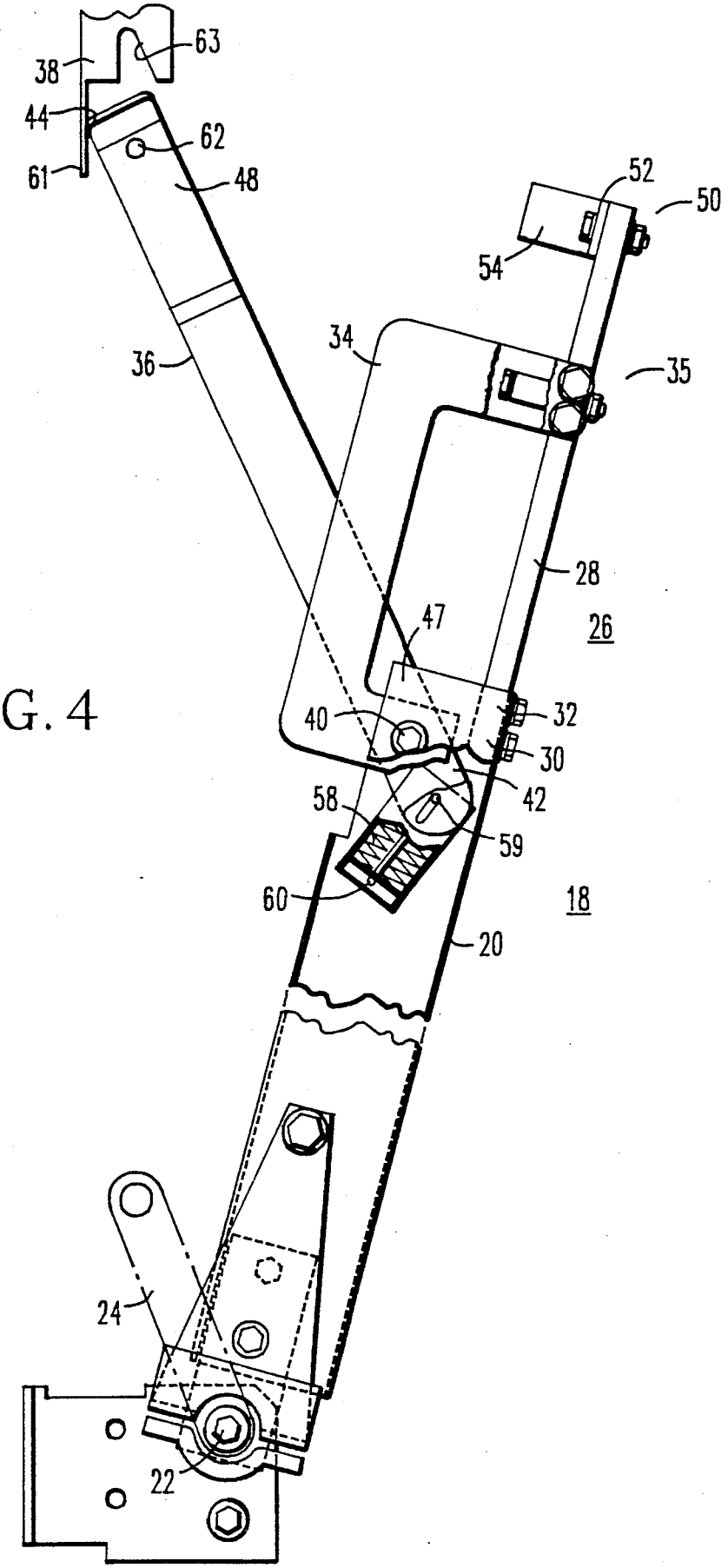
FIG. 4 is a side elevation, partly in section, of a partly closed assembly with the toggle blade making initial contact with a stop member, shown with break-jaw contacts in fragmentary view.

The ground blade assembly 18 in closed position is shown in FIGS. 2 and 3 and in partially open position in FIG. 4, with the toggle blade 36 shown in enlarged fragmentary front elevation in FIG. 5. Referring to FIGS. 2 and 3, in closed position the toggle blade 36 makes a solid electrical connection with a fixed break-jaw means 38 which is electrically connected to the current source terminal 14.

The details of the toggle blade can be better understood by referring to FIGS. 4 and 5 in conjunction with FIGS. 2 and 3. A toggle blade hinge 40 connects proximate one end 42 of the toggle blade 36 to the conductor coil 34 at a location proximate the end 30 of the rigid conductor member 28. The other end 44 of toggle blade 36 is rotatable through a limited arc with respect to the rigid conductor member 28. The toggle blade 36 is electrically connected to the conductor coil 34 proximate the toggle blade hinge 40 by conducting spacers 45. A first insulator means comprises insulating spacers 46 at the toggle hinge 40 positioned between a portion 47 of the conductor extension 20 and the conductor coil 34. This is best shown in FIG. 5 and the insulators 46 thus serve to electrically insulate the toggle blade 36 proximate the blade hinge 40 from the rigid conductors 20 and 28.

Referring to FIG. 5, the other end 44 of blade 36 comprises an electrical contact means 48 which makes a solid electrical connection with the break-jaw means 38 when the ground blade assembly is in closed current-carrying position, as shown in FIGS. 2 and 3. As shown in FIG. 2, in the closed position, the other end 44 of the toggle blade 36 extends beyond the other or extending end 50 of the conductor member 28. Alternatively, the member 28 could be lengthened so that insulator pad 52, described hereinafter, would engage the break jaws 38 when the blade assembly is in closed position.

Referring to FIGS. 2 and 3, in the closed position the toggle blade 36 is maintained in closely spaced but electrically insulated relationship with respect to the substantial length of the conductor member 28 by a second insulating means 52 which comprises a one-quarter inch (6.4 mm) insulating pad between the toggle blade 36 and the conductor member 28. As shown in FIGS. 2 and 3, side movement of the blade 36 is restricted by extending supports 54 affixed to the end portion 50 of conductor member 28. The inner surface of the supports 54 carry insulating pads 56 thereon. During momentary current surges of 100,000 amperes, for example, the resulting stresses on the ground blade can cause substantial movement of the ground blade components thus making the side-movement restraints a desirable feature.

The toggle blade 36 is normally urged toward an open position by suitable compression spring means 58 which urges the toggle blade 36 toward a counter-clockwise rotation, as viewed in FIG. 4. To illustrate the spring member 58, a portion of the end 42 of toggle blade 36 is cut away and the spring member 58 is shown partly in section. The blade end 42 connects to the spring member 58 through a pin 59. When the blade 36 is being moved to the fully closed position, the spring member is pivoted by the blade motion in a counter-clockwise direction about pin 60, as viewed in FIG. 4. This compresses the spring member 58. This spring force biases the toggle blade to the folded position shown in FIG. 4 thus insuring engagement of the blade locking member 62, see FIG. 5, with the slot 63 in the break jaws 38.

The toggle blade assembly 26 is shown in partially closed position in FIG. 4 wherein the electrical contact means 48 of the blade 36 is substantially spaced from the break-jaws 38. Closure of the blade assembly is accomplished with the manually operated lever linkage 24 which rotates the entire blade assembly in a counter-clockwise direction, as viewed in FIG. 4. Initially both the rigid conductor members 20 and 28 rotate counter-clockwise along with the toggle blade, until the end 44 of the blade 36 contacts the arresting stop member 61 which is firmly affixed proximate the break-jaws 38, see FIGS. 2 and 6. Further rotation of the blade assembly 20 in a counter-clockwise direction causes the toggle blade 36 to move upward the break-jaws as it rotates about the hinge 40. Still further rotation of the blade assembly 18 toward a closed position causes initial contact between the electrical contacts 48 of the toggle blade and the break-jaws 38 and rotation of the blade assembly is continued until the toggle blade 36 is firmly seated against the second insulator 52 and secure electrical contact is established between the contacts 48 of the toggle blade and the break jaws 38.

Referring to FIG. 5, the blade locking member 62 is provided proximate the contacts 48 of the toggle blade and this member 62 carries compression springs 64 between the member 62 and the outer blade surfaces to spring load the contacts 48 against the break jaws 38. The intermediate support members 66 provide truss support strength for the toggle blade.

Consider the situation where the ground blade assembly is in a closed current-conducting position and a short circuit accident occurs to apply potential to the break jaws 38. The path of current flow from the terminal 14 to ground is shown with directional arrows in FIG. 2. Current will flow from the break-jaw means 38 and into the toggle blade 36. Current will then flow through the toggle blade hinge 40 and into the conductor coils 34 and then through the conductor coils 34 and into the elongated conductor member 28, thence into the elongated conductor extension 20 and to ground. The current directions in the toggle blade 36 and the elongated conductor member 28 are both toward ground and the current flows in the substantial portion of the conductor coils 34 in the opposite direction. It is well known that when large currents flow in the same direction through closely spaced conductors, the spaced conductors are subject to electromagnetic forces which attract them to each other. In like fashion, if the currents in the closely spaced conductors flow in opposite directions, the spaced conductors are subject to forces which try to force them apart and the greater the current the greater the forces. In the present design, the currents flowing in the same direction through the closely spaced conductor 28 and the toggle blade 36 operate to force the toggle blade toward a closed position. In like fashion, the opposite currents in the main portion of the conductor coil 34 and the toggle blade 36 also operate to force the toggle blade 36 to a closed position. Thus under accidental fault conditions of extremely heavy current flow, the toggle blade assembly is effectively locked in closed current-carrying position.

Figure 6:
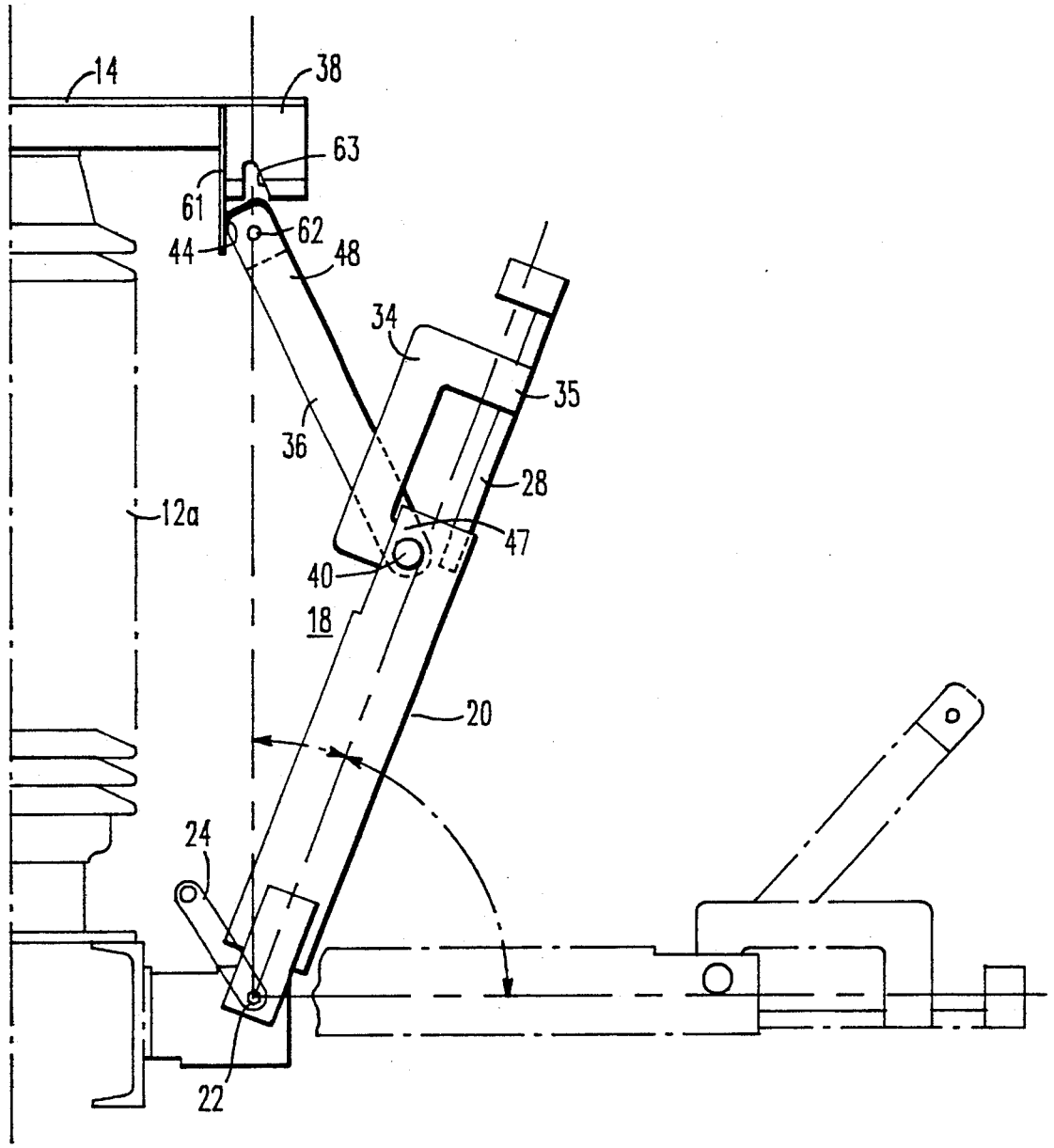
FIG. 6 is a diagrammatic view showing the toggle blade assembly in fully open position in broken lines and showing the toggle blade assembly in partially closed position in solid lines.

The operation of the toggle blade assembly 18 is diagrammatically shown in FIG. 6 wherein the blade in full open position is shown in broken lines and in partially closed position in solid lines. In the partially closed position, the end 44 of the blade 36 has made contact with the arresting stop member 61 and further rotation of the blade assembly toward a closed position causes the contacts 48 to move upwardly into contact with the break jaws 38. This causes the blade locking member 62 to move into the slot or slot means 63 of the break jaws 38. Further rotation of the assembly toward a fully closed position moves the blade 36 so that it is generally parallel to the conductor members 28 and 20 and the locking member 62 is securely nested in the slot 63 of break jaws 38, as shown in FIG. 2. In this fully closed position, the blade assembly 18 cannot be rotated or moved toward a partially open position without rotating the blade 36 with respect to the primary conductor member 28 and any such rotation of the blade 36 is prevented by the locking member 62 which is nested in the slot 63 of break jaws 38. Under conditions of accident or short circuit when very heavy currents can be encountered, the blade 36 cannot be rotated toward a partially open position since it is effectively locked in a fully closed position, as shown in FIG. 2, by the generated electromagnetic fields, as explained hereinbefore. This insures the safety of personnel servicing the protected equipment.

Various different embodiments can be utilized. For example, the conductor coils 34 are preferably a pair of conductor members as shown in FIGS. 2 and 3 between which the blade 36 rotates; alternatively, a portion of the center section of the coil members could be bent to meet one another. Various types of contacts could be substituted for the break-jaws 38 and also the contact portions 48 of the toggle blade. The elongated conductor extension 20 and the elongated conductor member 28 could be formed as a unitary member, if desired, particularly in the case of a very short overall blade assembly. While the present assembly has been described as a ground blade assembly, it could also be used as a disconnect switch wherein the switch terminals would be connected to the current mains to be disconnected, as shown in FIG. 1, rather than between a current main conductor and ground. Such an application as a disconnect switch would be desirable since the switch would never open under extreme conditions of current flow and the circuit would be opened at the designed location, namely the circuit breaker.

Referring to FIGS. 2 and 4, for special applications, the substantial portion of the elongated conductor extension 20 could be dispensed with. Such a modification would have utility in any lower voltage application where short duration, very high currents might be encountered, under which conditions the blade would effectively lock in closed current-carrying position.

I claim as my invention:

1. In combination with a toggle-type blade assembly having a closed current-carrying position and an open current-off position and comprising, a rigid elongated conductor means operable to carry very high currents, operating hinge means connected to one end of said rigid elongated conductor means, means for rotating said rigid elongated conductor means through a limited arc and about said operating hinge means to open and close said blade assembly, a toggle blade supported at one end thereof by a toggle blade hinge at a location spaced a predetermined distance from the other end of said rigid elongated conductor means, said toggle blade being rotatable through a limited arc, the other end of said toggle blade comprising electrical contact means, fixed break-jaw means electrically connected to a current terminal, the other end of said toggle blade comprising electrical contact means which is operable to make secure electrical connection with said break-jaw means when said blade assembly is in closed position and to be spaced from said break-jaw means when said blade assembly is in open position, and means for normally urging said toggle blade to said open current-off position, the improvement which comprises:

conductor coil means rigidly electrically connected to said rigid elongated conductor means at a location which is spaced a predetermined distance from said toggle blade hinge and toward said other end of said rigid elongated conductor means, said conductor coil means (1) first extend away from said rigid elongated conductor means and toward said toggle blade and (2) then bend to extend generally parallel to said rigid elongated conductor means and toward said toggle blade hinge to space said conductor coil means from said rigid elongated conductor means and (3) then bend toward said rigid elongated conductor means and electrically connect to said toggle blade hinge;

first insulating means proximate said toggle blade hinge and electrically insulating said toggle blade from said rigid elongated conductor means, and second insulating means which electrically insulates the remaining length of said toggle blade from said rigid elongated conductor means and maintains a predetermined spacing between said toggle blade and said rigid elongated conductor means when said toggle blade is in a closed current-carrying position; and when said toggle-blade assembly is in a closed current-carrying position, current can flow from said break-jaw means and through said toggle-blade and then in reverse direction through said conductor coil means, then from said conductor coil means and into said rigid elongated conductor means; whereby under conditions of extremely heavy current flow the respective reverse directions of current flow and resultant generated electromagnetic forces lock said toggle blade assembly in a closed position.

2. The combination as specified in claim 1, wherein said combination has application as a ground blade, and said one end of said rigid elongated conductor means is connected to ground.

3. The combination as specified in claim 1, wherein said conductor coil means comprises a pair of spaced apart heavy conductor members between which said toggle blade can rotate through a limited arc.

4. The combination as specified in claim 1, wherein a fixed arresting stop member is positioned proximate said break-jaw means to move said toggle blade into electrical contact with said break jaw means as said combination is moved toward a closed current-carrying position.

5. The combination as specified in claim 1, wherein said toggle blade hinge is partially supported by a said elongated conductor means, and said first insulating means comprises insulating spacer means positioned between said elongated conductor means and said conductor coil means.

6. The combination as specified in claim 1, wherein said break-jaw means is provided with slot means, and said electrical contact means of said toggle blade includes a blade locking member which nests into said slot means of said break-jaw means when said combination is in closed current-carrying position to effectively prevent moving said toggle-blade assembly from a closed position under conditions of extremely heavy current flow.

7. A toggle blade combination having a closed current-carrying position and an open current-off position, said toggle blade combination comprising:

a rigid elongated conductor means operable to carry very high currents, blade hinge means proximate to and supported by said rigid elongated conductor means a predetermined distance from one end of said rigid elongated conductor means, an elongated electrically conducting toggle blade supported at one end thereof by said blade hinge means and rotatable on said blade hinge means through a limited arc to open and close said toggle blade combination, electrical contact means comprising the other end of said toggle blade, when said toggle blade combination is in open position said toggle blade is rotated on said blade hinge means to space said electrical contact means away from said rigid elongated conductor means, when said toggle blade combination is in closed position said toggle blade is rotated on said blade hinge means to be generally parallel to and in close proximity to said rigid elongated conductor means, separate fixed contact means making secure electrical contact with said electrical contact means when said toggle blade combination is in closed position, said electrical contact means extending beyond the other end of said rigid elongated conductor means when said toggle blade combination is in closed position, means for normally urging said toggle blade toward an open position, and means for rotating said toggle blade from an open to a closed position and from a closed to an open position;

conductor coil means rigidly electrically connected to said rigid elongated conductor means at a location which is spaced a predetermined distance from said blade hinge means and toward said other end of said rigid elongated conductor means, said conductor coil means (1) first extend away from said rigid elongated conductor means and toward said toggle blade and (2) then bend to extend generally parallel to said rigid elongated conductor means and toward said blade hinge means to space said conductor coil means from said rigid elongated conductor means and (3) then bend toward said rigid elongated conductor means and electrically connect to said blade hinge means;

first insulating means proximate said blade hinge means and electrically insulating said toggle blade from said rigid elongated conductor means, and second insulating means which electrically insulates the remaining length of said toggle blade from said rigid elongated conductor means and maintains a predetermined close spacing between said toggle blade and said rigid elongated conductor means when said toggle blade is in a closed position, and an electrically conducting spacer forming a part of said blade hinge means and positioned between said conductor coil means and said toggle blade; and when said toggle blade combination is in a closed current-carrying position, current can flow away from said fixed separate contact means and through said toggle blade and then in reverse direction through said conductor coil means, then from said conductor coil means and into said rigid elongated conductor means, and then from said rigid elongated conductor means; whereby under conditions of extremely heavy current flow the respective directions of current flow and resultant generated electromagnetic forces effectively lock said toggle blade combination in a closed position.

8. The combination as specified in claim 7, wherein said conductor coil means comprises a pair of spaced apart heavy conductor members between which said toggle blade can rotate through a limited arc.

9. The combination as specified in claim 7, wherein a fixed arresting stop member is positioned proximate said fixed separate contact means to move said toggle blade into electrical contact with said fixed separate contact means when said blade combination is moved toward a closed current-carrying position.

10. The combination as specified in claim 7, wherein said blade hinge means is partially supported by said elongated conductor means, and said first insulating means comprises insulating spacer means positioned between said elongated conductor means and said conductor coil means.

11. The combination as specified in claim 7, wherein said separate fixed contact means is provided with slot means, and said electrical contact means of said toggle blade includes a blade locking member which nests into said slot means of said separate fixed contact means when said combination is in closed current-carrying position to effectively prevent moving said toggle blade combination from a closed position under conditions of extremely heavy current flow.

12. A combination blade assembly operable to handle very high currents and having an open current-off position and a closed current-carrying position, said blade assembly comprising:

a rigid conductor extension operable to carry very high currents, said rigid conductor extension hinged and limitedly rotatable about one end thereof and having said contact blade assembly affixed to the other end thereof, said hinged end of said rigid conductor extension adapted to be connected to an electrical terminal, and means for rotating said rigid conductor extension through a limited arc about the hinged end thereof to open and close said blade assembly;

said blade assembly comprising a rigid primary conductor adapted to carry very heavy currents and rigidly connected at one end thereof to said other end of said rigid conductor extension, a pair of spaced apart heavy conductor members each rigidly electrically connected to said rigid primary conductor at a location which is substantially spaced from said one end of said rigid primary conductor, said pair of spaced apart conductor members (1) first extend away from said rigid primary conductor and (2) then bend to extend toward said one end of said rigid primary conductor to space said pair of conductor members from said rigid primary conductor and (3) then bend toward said rigid primary conductor toward a location proximate said one end of said rigid primary conductor member, and the bent configuration of said pair of conductor members comprising three sides of a coil;

an elongated electrically conducting toggle blade means, blade hinge means connecting said toggle blade means proximate one end thereof to said pair of spaced conductor members at a location proximate said one end of said rigid primary conductor, said toggle blade means being rotatable through a limited arc between said pair of conductor members, said toggle blade means electrically connected proximate said blade hinge means to said pair of spaced conductor members but electrically insulated proximate said blade hinge means from said rigid primary conductor, said other end of said toggle blade means comprising an electrical contact means, said toggle blade means having an open non-current-carrying position in which said other end of said toggle blade means is rotated away from said rigid primary conductor and a closed current-carrying position in which said toggle blade means is positioned in close proximity to but spaced from said rigid primary conductor, and means for normally urging said toggle blade means toward an open position;

break-jaw means affixed proximate said other end of said toggle blade means, said break-jaw means electrically connected to an electrical terminal and making secure electrical connection with said electrical contact means of said toggle blade means when said assembly is in a closed current-carrying position; and said assembly is operable to be moved from an open position to a closed position by rotating said rigid conductor extension which rotates said toggle blade means toward said rigid primary conductor to cause said electrical contact means of said toggle blade means to initially contact said break-jaw means, and further rotation of said rigid primary conductor effecting a solid electrical connection between said electric contact means of said toggle blade means and said break-jaw means and also maintaining said toggle blade means in a closed current-carrying position; whereby in the case of a large current surge when the assembly is in closed position, current flows in the same direction through said rigid primary conductor and said toggle blade means and in the opposite direction through a substantial portion of said pair of conductor means with the respective directions of current flow and the resulting generated electromagnetic forces preventing said assembly from moving to an open position under the stresses of external forces.

13. The blade assembly as specified in claim 12, wherein said blade assembly is adapted to function as ground blade assembly, said break-jaw means is connected to a terminal of the current mains to be grounded, and said hinged end of said rigid conductor extension is connected to ground.

14. The blade assembly as specified in claim 12, wherein a fixed arresting stop member is positioned proximate said break-jaw means to move said toggle blade means into electrical contact with said break-jaw means when said assembly is moved toward a closed current-carrying position.

15. The combination as specified in claim 12, wherein said break-jaw means is provided with slot means, and said electrical contact means of said toggle blade includes a blade locking member which nests into said slot means of said break-jaw means when said combination is in closed current-carrying position to effectively prevent moving said blade assembly from a closed position under conditions of extremely heavy current flow.

* * * * *